United States Patent [19]

Bossany

[11] Patent Number: 4,569,174

[45] Date of Patent: Feb. 11, 1986

[54] INSULATION FOR BUILDINGS

[76] Inventor: John A. Bossany, 51 Mountain Ave., Warren, N.J. 07060

[21] Appl. No.: 438,250

[22] Filed: Oct. 11, 1982

[51] Int. Cl.[4] ..... E04B 2/00

[52] U.S. Cl. [4] ..... 52/406; 52/404; 52/712

[58] Field of Search ..... 52/407, 712, 404, 406; 428/101

[56] References Cited

U.S. PATENT DOCUMENTS

| | | | |
|---|---|---|---|
| 2,094,635 | 10/1937 | Brooks | 52/407 |
| 2,181,074 | 11/1939 | Scott | 189/34 |
| 2,239,394 | 4/1941 | MacKechnie | 52/407 |
| 2,335,968 | 12/1943 | Sawtell | 20/4 |
| 2,355,203 | 11/1967 | Stauffer | 287/189.35 |
| 3,231,944 | 2/1966 | Bennett | 52/406 |
| 4,023,323 | 5/1977 | Fortin | 52/404 |
| 4,047,346 | 9/1977 | Alderman | 52/407 |
| 4,292,775 | 10/1981 | Howard | 52/220 |
| 4,437,282 | 3/1984 | O'Brien | 52/407 |

FOREIGN PATENT DOCUMENTS

| | | | |
|---|---|---|---|
| 2315793 | 10/1974 | Fed. Rep. of Germany | 52/407 |

*Primary Examiner*—Donald G. Kelly
*Assistant Examiner*—Kathryn L. Ford
*Attorney, Agent, or Firm*—Eugene S. Cooper

[57] ABSTRACT

Building insulation for installation between joists above a crawl space, basement or garage area comprising a layer of insulating material having a vapor barrier layer on the top thereof and a flexible reticulated member at the bottom thereof, such member having fastening flanges thereon extending downwardly and adapted to be secured to the sides of the joists, whereby the reticulated member supports the insulating material and vapor barrier layer.

6 Claims, 10 Drawing Figures

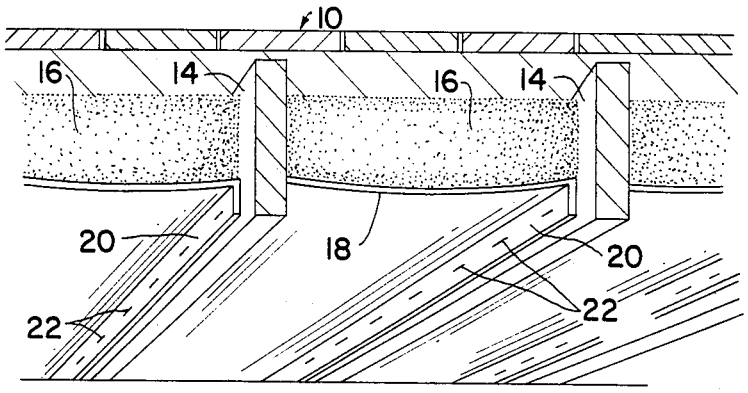
FIG. 1
PRIOR ART
FIG. 3
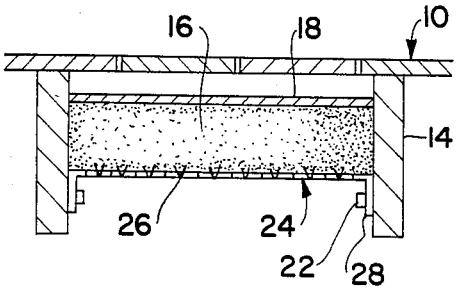
FIG. 2
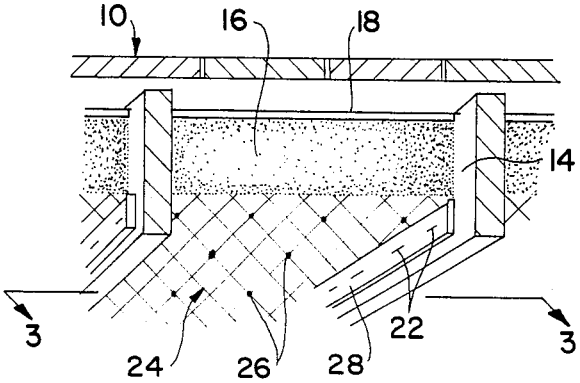
FIG. 4
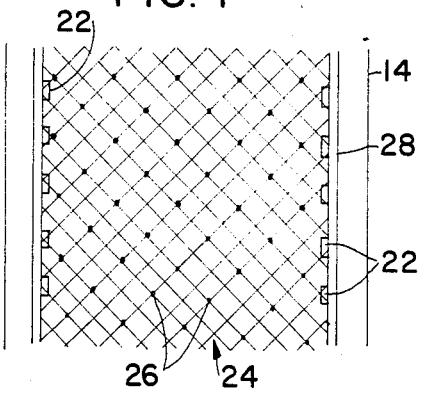
FIG. 6
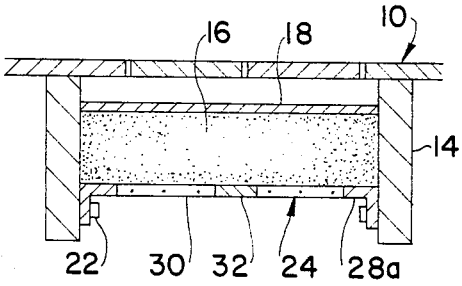
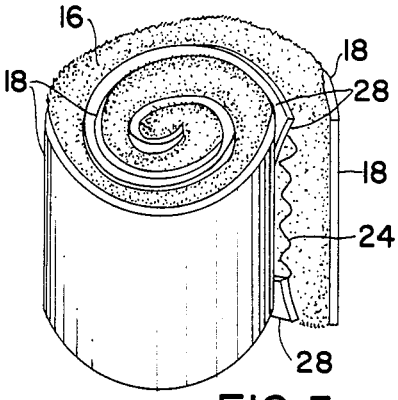
FIG. 5
FIG. 7
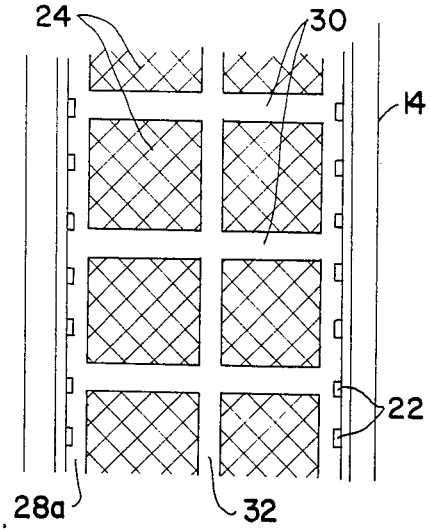

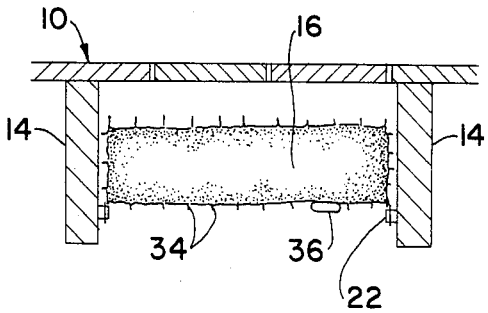
FIG.8
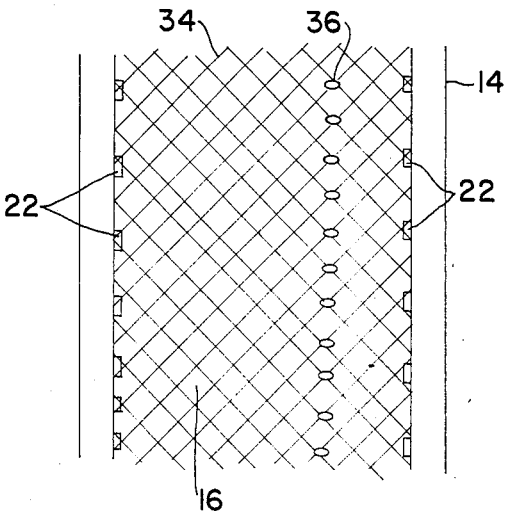
FIG.9
FIG.10
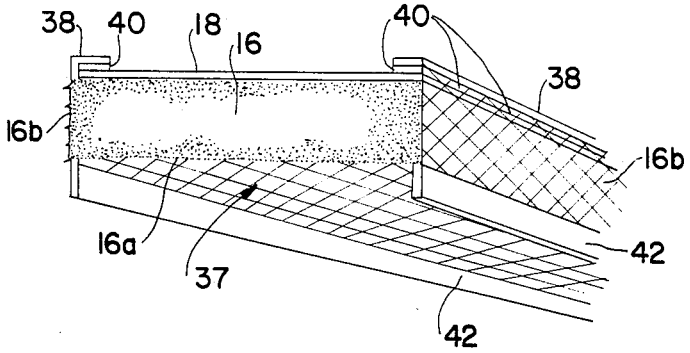

INSULATION FOR BUILDINGS

BACKGROUND OF THE INVENTION

This invention relates to building insulation and more particularly to such insulation for use particularly in floors above crawl spaces, garages and basements of heated buildings.

It is common practice to insulate buildings with batts of fibrous insulating material, such as glass wool and the like, to which a vapor barrier layer is applied on one side thereof, as is well known. Proper installation of these batts requires that they be installed with the vapor barrier layer facing the heated area, i.e., the inside of the building structure.

The vapor barrier layer of these batts is provided with fastening lips or flanges in the form of elongated extended edge portions running along the length of the batts on the opposite sides thereof. When it is desired to install the batts in the walls of buildings it is merely necessary to insert them in place between the wall studs and secure the flanges to the studs by nails or building staples. This is a very simple and quick operation to accomplish since the vapor barrier layer is installed away from the outer wall of the building. i.e., closest to the inner wall to be installed over the insulation batt.

The use of such batts for insulating the floor over a crawl space or basement, however, presents several difficulties. Since the vapor barrier layer should be installed facing upward, it is extremely difficult to nail or staple the fastening flanges thereof to the overhead floor joists because the insulating material fills the space between the joists. Accordingly, it has become a not-uncommon practice by workmen to install the batts so the vapor barrier layer thereof faces downward so they can quickly and easily staple the fastener flanges to the floor joists. This, of course, places the vapor barrier layer in the improper position, whereby it "encloses" the insulating material of the batt between the barrier layer and the inside atmosphere of the building. This results eventually in the formation of condensation in the insulating material, thus substantially reducing its effectiveness as a heat insulator.

SUMMARY OF THE INVENTION

It is an object of this invention to provide an improved unitary building insulation structure which can be rapidly and efficiently installed between the joists of a floor-like horizontal structure.

Another object of this invention is to provide a means for installing insulation in a substantially horizontal position in an easy manner and in accordance with proper building practice.

Still another object of the invention is to provide improved batts of insulation for use between the joists of a floor-like structure whereby the vapor barrier layer faces upward and whereby the fibrous insulation material is held in place by an underneath supporting means which will allow relatively uniform support along the length of the batt to prevent sagging thereof.

Yet another object of the invention is to make it easier for workers to install insulation in batting form in the proper manner in the floor above a crawl space or basement area, whereby condensation in the insulating material resulting from "reverse vapor layer" installation is avoided.

In accordance with the above objectives, one embodiment of my invention provides for a unitary insulation structure comprising a layer of heat insulating material having a layer of relatively thin material on one side thereof for restricting the passage of water vapor therethrough and on the other side a flexible reticulated support material. When installed between the beams or joists of a floor-like structure, the reticulated support material is at the bottom of the unitary insulation structure and provides a uniform support for the insulation layer thereof. In another embodiment of the invention the reticulated support material may be provided not as an integral part of the unitary insulation structure, but rather as a separate support material in order to prevent sagging of conventional insulating material held in place thereby by providing uniform support therefor.

DESCRIPTION OF THE DRAWINGS

The foregoing and other objects, features and advantages of the invention will be more readily understood from the following description when taken in conjunction with the accompanying drawings in which like numerals indicate like parts and in which:

FIG. 1 is a fragmentary perspective view of one manner of installing an insulation batt between floor joists according to one prior art technique;

FIG. 2 is a view similar to FIG. 1 but showing the construction and installation of a unitary insulation structure or batt in accordance with one embodiment of this invention;

FIG. 3 is a cross-sectional view of the insulation structure of FIG. 2 taken along line 3—3 thereof;

FIG. 4 is a plan view of the structure of FIG. 2 viewed from underneath the floor in which it is installed;

FIG. 5 illustrates one of the batts shown in FIGS. 2, 3 & 4 in rolled up form for storage and shipping;

FIGS. 6 and 7 are cross-sectional and plan views respectively, similar to FIGS. 3 and 4, of another embodiment of the invention;

FIGS. 8 and 9 are cross-sectional and plan views respectively, also similar to FIGS. 3 and 4, of still another embodiment of the invention; and FIG. 10 is a perspective view of a still further embodiment of the invention.

DESCRIPTION OF THE PREFERRED EMBODIMENTS

Referring now particularily to FIG. 1, there is shown a floor 10 above a crawl space or basement and supported by joists 14 between which is installed insulation 16 in the form of batts of standard width fibrous material of a type well known in the prior art and which may be made of glass wool or the like. These batts usually include a vapor barrier layer 18 made of tarpaper or other suitable material and secured by any appropriate adhesive during manufacture to the insulation material 16. The vapor barrier layer 18 is provided with fastening flanges 20 whereby nails or staples 22 are used to secure the batt in position between the joists 14. It will be appreciated that the specific insulation as just described and as seen in FIG. 1 is improper because the vapor barrier 18 is on the lower side of the insulation batts, rather than the upper side as is done in accordance with good building practice. While this is not done by all builders, it is however, practiced sufficiently widely to be of concern to those in the building industry.

In accordance with one embodiment of the invention I provide an improved unitary insulation structure and installation therefor as seen in FIGS. 2, 3, and 4 which facilitates proper installation of the insulating material in the floor above a crawl space or basement. Thus in FIGS. 2, 3 and 4 the vapor barrier layer 18 is provided in the proper position on the upper surface of the insulation material 16, rather than on the lower surface thereof as in FIG. 1. The insulation material 16 is supported by a reticulated support member 24, which is preferably non-metallic and may be in the form of a plastic fish net-like material. The member 24 may be made of a variety of materials and in a variety of shapes, but should be relatively flexible. The member 24 in this embodiment is secured to the insulation material 16 by fastening means such as glue, clips or other suitable securing device, at the points indicated by the numerals 26. The entire unitary insulation structure comprising the insulation material 16, vapor barrier layer 18 and support member 24 is secured in place between the joists 14 by means of the staples 22 driven into the joists through fastening flanges 28, which are provided as an integral part of the support member 24.

FIG. 5 shows one of the batts seen in FIGS. 2, 3 and 4, rolled up to illustrate the manner in which the fastening flanges 28 are folded securely within the roll between the layer of insulating material 16 and the vapor barrier layer 18. It will be seen that the improved unitary insulation structure of this invention allows the formation of a roll suitable for stacking one upon another for storage and also suitable for shipping without the precautions and shipping modifications necessary with some of the insulation materials found in the prior art.

In FIGS. 6 and 7 there are shown cross-sectional and plan views, respectively, similar to FIGS. 3 and 4, of another embodiment of the invention. In FIGS. 6 and 7 the fastener flanges are provided in the shape of right angle flanges 28*a* integral with the reticulated support member 24 and which may be secured to the insulation material 16 in the manner the webbing portion of the member 24 is secured thereto as set forth in the description of FIGS. 2, 3 and 4 above. Additional transverse and longitudinal supporting sections 30 and 32 respectively, are also provided, as best seen in FIG. 7, to provide more adequate support for the insulation material 16 for certain applications.

FIGS. 8 and 9 illustrate in cross-section and plan views respectively, similar to FIGS. 3 and 4, yet another embodiment of the invention. In these figures a batt of insulation material 16 with its vapor barrier layer 18, is shown enclosed within an elongated envelope 34 of flexible reticulated support material of the type best seen in FIG. 4 and installed between the two joists 14. The envelope 34 may be formed by wrapping it around the insulation material 16 in the manner of wrapping a package, and securing the meeting edges as by the small clips 36 or gluing them to the vapor barrier layer 18. Alternatively if desired, instead of wrapping the reticulated support material to form the envelope 34 around the insulation material 16, it may be provided as a preformed circumferentially continuous envelope into which the insulation material is placed to form the structure illustrated in FIGS. 8 and 9. Using this envelope-type construction, it is not necessary to secure the envelope 34 to the insulation material 16 or to the vapor barrier layer 18, as described in connection with FIGS. 3 and 4. With this embodiment it will be appreciated that the unitary insulation structure batts can be installed by using building staples 22 to tack the individual strands of the envelope 34 of reticulated support material to the joists 14 at the point of contact therebetween.

In FIG. 10 there is shown yet a further embodiment of the unitary insulation structure of this invention. In this embodiment a reticulated support member 37, having longitudinally extending flanges 38, is wrapped around the bottom 16*a* and also the vertical edges 16*b* of the insulation material 16. These flanges 38 are secured, as by glue or other suitable fastening means, to the vapor barrier layer 18 at the points 40 along the peripherial edge regions of this layer, thus forming an envelope around the insulating material 16. The reticulated member 37 also includes fastening flanges 42, which may be integral therewith, for fastening the batt to its adjacent joists.

It will be appreciated that the embodiment of FIG. 10 provides a relatively rugged unitary insulation batt which can be handled easily and without fear of being too easily damaged and which can be installed by means of the flanges 42 in a rapid, efficient and convenient manner. This construction is therefore extremely cost effective to install and of course, makes it impossible for workmen to install the batts improperly with the vapor barrier layer 18 in the downward position. It will also be appreciated that, if desired, to reduce the cost of manufacture, the construction of FIG. 10 could be modified to eliminate the installation flanges 42 and installation could still be performed with staples around the individual strands of the recticulated member 37 where they meet the joists, as is done with the arrangement of FIGS. 8 and 9.

The flanges, however, are preferable since they make it possible for the workmen to carry out installation of the batts in an extremely rapid manner, particularily when done with staple guns of the type used in the building industry.

It will be further appreciated that the novel reticulated support member of this invention may be provided as a separate item and used with conventional insulation batts of material to support the same in place between the flooring joists. While ordinary plastic-type netting may be used for the reticulated support member, it would be preferable to provide it in the general form indicated by the numeral 24 in FIGS. 2, 3 and 4, i.e., with the fastening flanges 28 as an integral part thereof, in order to facilitate more speedy installation of the batts. With this modification it will also be clear that the fastening of the member 24 to the insulation 16, as indicated by the numeral 26 in FIGS. 2, 3 and 4, is unnecessary and therefore need not be carried out.

Since many changes could be made in the above construction and many apparently widely different embodiments of this invention could be made without departing from the scope therof, it is intended that all matter contained in the above description or shown in the accompanying drawings shall be interpreted as illustrative and not in a limiting sense.

I claim:

1. An insulation structure comprising:

a layer of insulating material for restricting the transfer of heat from one side of said layer to the other side thereof and adapted to be installed in a substantially horizontal position, a layer of material to serve as a vapor barrier on the upper side of said layer of insulating material, and a non-metallic support member including a reticulated portion formed of highly pliable plastic fish net-like material on the lower side of said layer of insulating material and extending for substantially the length and width of said layer of insulating material, said support member including fastening means at opposite edges thereof and integral therewith, said fastening means being in the form of substantially solid flanges at the opposite edges of said layer of insulating material and adapted to extend downwardly therefrom, said flanges further being formed of the same material as the reticulated portion of said support member and being capable of being easily pierced by building staples, whereby said staples may be used to secure said flanges to floor supporting joists adjacent to said insulation structure thereby to support said structure.

2. An insulation structure as defined in claim 1 wherein said reticulated portion of said support member is in the form of a continuous envelope which encloses the bottom end sides of said insulating material and also said layer of vapor barrier material.

3. An insulation structure as defined in claim 1 wherein said reticulated portion of said support member further includes supporting sections integral therewith and extending both transversely and longitudinally of the direction of the length of said structure.

4. An insulation structure as defined in claim 1 wherein said reticulated portion of said support member also embraces the opposite vertical sides of said layer of insulating material and is secured to the opposite peripheral edges of the layer of vapor barrier material.

5. An insulation structure as defined in claim 4 wherein the securing of said reticulated support member is achieved by longitudinal flanges thereon which are attached to said opposite peripheral edges of the layer of vapor barrier material.

6. In an insulation structure for installation between the floor joists of a heated building including a layer of fibrous insulating material and a layer of vapor barrier material on the upper side of said layer of insulating material, the improvement comprising:

an elongated member including a reticulated portion formed of a non-metallic highly pliable plastic net-like material adapted to support said insulating material at the lower side thereof, said member extending for substantially the length and width of said layer of insulating material and including fastening means in the form of substantially solid flanges at the opposite edges of said member, said flanges being formed of the same material as the reticulated portion of said member, and said flanges being adapted to extend downwardly from said insulating material and to serve as fastening means when secured to the joists adjacent thereto, said flanges further being capable of being easily pierced by building staples, whereby said structure may be quickly secured between said floor joists.

* * * * *